United States Patent [19]

Raisanen

[11] Patent Number: 4,850,265

[45] Date of Patent: Jul. 25, 1989

[54] AIR INTAKE APPARATUS

[75] Inventor: Niilo A. A. Raisanen, Cokato, Minn.

[73] Assignee: Raydot Incorporated, Cokato, Minn.

[21] Appl. No.: 214,208

[22] Filed: Jul. 1, 1988

[51] Int. Cl.[4] ..... F24F 7/02

[52] U.S. Cl. ..... 98/37; 98/64; 98/119

[58] Field of Search ..... 98/33.1, 35, 37, 39.1, 98/41.1, 64, 117, 119, 42.2, 42.21; 119/16

[56] References Cited

U.S. PATENT DOCUMENTS

| | | | |
|---|---|---|---|
| 1,613,897 | 1/1927 | Lighty et al. | 98/119 X |
| 2,057,627 | 10/1936 | Ferris | 98/33.1 |
| 2,502,736 | 4/1950 | Marcoe | 98/37 X |
| 3,174,423 | 3/1965 | Rigterink et al. | 98/37 X |
| 3,299,798 | 1/1967 | Nabben | 98/37 X |
| 3,919,927 | 11/1975 | Bernard, Jr. | 98/37 X |
| 4,334,577 | 6/1982 | George | 98/119 X |

FOREIGN PATENT DOCUMENTS

| | | | |
|---|---|---|---|
| 514410 | 2/1955 | Italy | 98/37 |
| 2049160 | 12/1980 | United Kingdom | 98/37 |

*Primary Examiner*—Harold Joyce
*Attorney, Agent, or Firm*—Palmatier & Sjoquist

[57] ABSTRACT

A cupola having a set of upper and lower elongate openings. A pair of baffles are disposed in the cupola so as to capture rain driven in through the upper opening and subsequently divert the rain out through the lower openings. A pair of flanges are affixed to the cupola to deflect wind driven articles away from the lower openings. Air flowing into the cupola, which is mounted on a roof of a building, is directed by a duct to a counterweight valve, which is affixed in the building. The counterweight valve includes a flap which is counterbalanced by a counterweight. The flap opens and closes in response to static pressure in the building.

16 Claims, 3 Drawing Sheets

AIR INTAKE APPARATUS

BACKGROUND OF THE INVENTION

1. Field of the Invention

The present invention relates to air intake apparatus and more particularly to air intake apparatus surmounting a roof of a structure.

2. Description of the Prior Art

Since the medieval times, cupolas have been utilized on the roofs of buildings, such as on mosques, to admit air and provide for the escape of smoke or polluted air. In more conventional times, spiral shaped spinning louvers may have been attached to roofs for ventilation.

Instead of mechanical apparatus, powered devices such as power vents and fans may be used to draw in fresh air and exhaust contaminated air. Powered apparatus are typically utilized in agricultural buildings such as barns and in industrial and commercial buildings such as warehouses.

A conventional ventilation system provides for both intake and exhaust. It is typical for a powered ventilator to control both the intake of fresh air and the exhaust of noxious air.

SUMMARY OF THE INVENTION

A feature of the present invention is a cupola having a first set of upper elongate openings for the intake of fresh air. The upper openings are vertically disposed in opposing sidewalls of the cupola to capture frontal air flow or wind blowing directly on the cupola.

A second pair of lower elongate openings for air intake is formed below the upper pair of elongate openings. The lower openings are disposed horizontally in the opposing sidewalls and have extended overhangs or eaves so that air rising vertically off the roof of the building by heat or turbulent wind may travel upwardly into the cupola.

A pair of oblique baffles are disposed inwardly of the upper openings to catch wind driven moisture. A lower portion of the baffles is oriented outwardly to be disposed above the lower openings. Water, typically rain, flows off the lower portion of the baffles and out the lower openings.

A pair of deflecting flanges are located beneath the baffles and form edges of the lower openings to deflect, for example, wind driven snow. The flanges project downwardly and outwardly from the sidewalls of the cupola.

Screens are connected at the openings to prevent the intake of wind driven articles such as leaves and paper. The screens for the lower openings extend over and protect the snow deflecting flange from damage by wind driven articles.

A pair of counterweight valves is connected downstream from a cupola to a ceiling of a building such as a warehouse. The counterweight valves cooperate with the cupola through a duct connecting the valve to the cupola.

Each counterweight valve has a pair of rigid flaps. Each flap is controlled by a counterweight connected thereto and extending therefrom to the exterior of the valve. Each flap covers an opening formed in the valve through which air flows to the interior of the building.

In operation, power ventilation apparatus may draw contaminated air from the building to which a cupola and counterweight valve are affixed. As air is drawn from the building a negative pressure is created therein relative to the pressure on the exterior of the building. When the negative pressure is created, the flaps open the distance prescribed by the counterweight. Air then flows through the openings and duct to the counterweight valve where the air is directed through the valve openings and horizontally across the interior space.

The oblique baffles catch rain driven by the wind through the upper openings. The oblique baffles then deflect the rain which flows off the baffle and out of the cupola through the lower openings. The deflecting flange disposed at the lower opening prevents rain or water adsorbed by the surface of the cupola from being driven into the cupola by the wind. The flange also prevents wind driven snow from collecting or being drawn into the cupola.

A feature of an alternate embodiment of the valve includes a modulating damper disposed in the cupola. The modulating damper may include a pivoting panel controlled by ropes extending downwardly therefrom.

An advantage of the present invention are the relative orientations of the openings. The upper openings are generally accessible to frontal air flow or wind blowing directly on the cupola. The lower openings are accessible to and capture air flow created by the building. Turbulent air flow created by the roof and cupola may be directed upwards and into the lower openings. Air flow created by the temperature difference between the roof of the building and the outside air rises into the lower openings to be captured by the cupola. Hence a diversified supply of air exists for intake by the counterweight or modulating valve.

Another advantage of the present invention is that the oblique baffles cooperate with both the upper and lower openings to dispense moisture. The baffles catch rain driven through the upper openings and subsequently direct the moisture out of the cupola through the lower openings.

Still another advantage of the present invention is that the deflecting flanges prevent wind driven particulates from entering the cupola. Particulates such as snow or sand tend to track on the roofs of structures. With the deflecting flanges of the lower opening, the particulates are driven away from the openings in the cupola. Moreover, the deflecting flanges lower the physical energy of the wind driven particulates.

Still another advantage of the invention is that the openings are elongated. For a given amount of area, the elongate openings allow a greater diversification of air into the cupola than, for instance, circular openings.

Still another advantage of the present invention is that the overhangs are multipurpose. The overhangs not only avert water away from the upper and lower openings, but also capture air deflected by the roof and cupola and divert it into the cupola through the lower openings.

DETAILED DESCRIPTION OF THE PREFERRED EMBODIMENT

Figure 1:
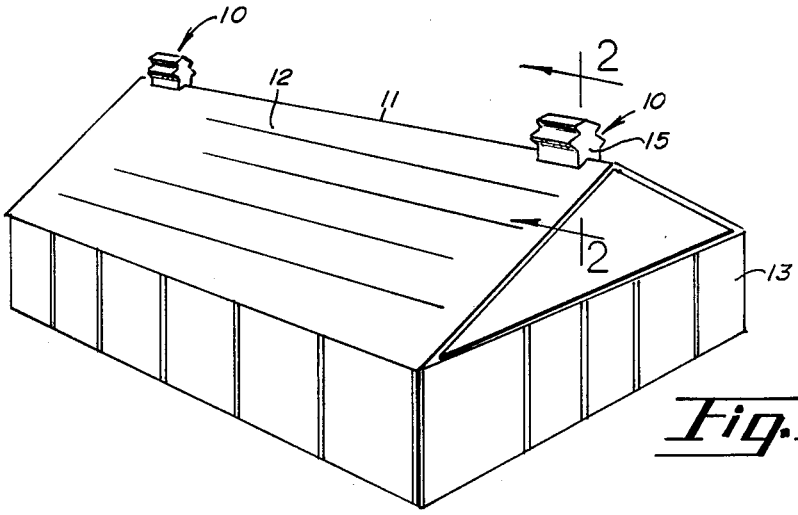
FIG. 1 is a perspective view of the air intake apparatus connected to the exterior of a structure.
Figure 2:
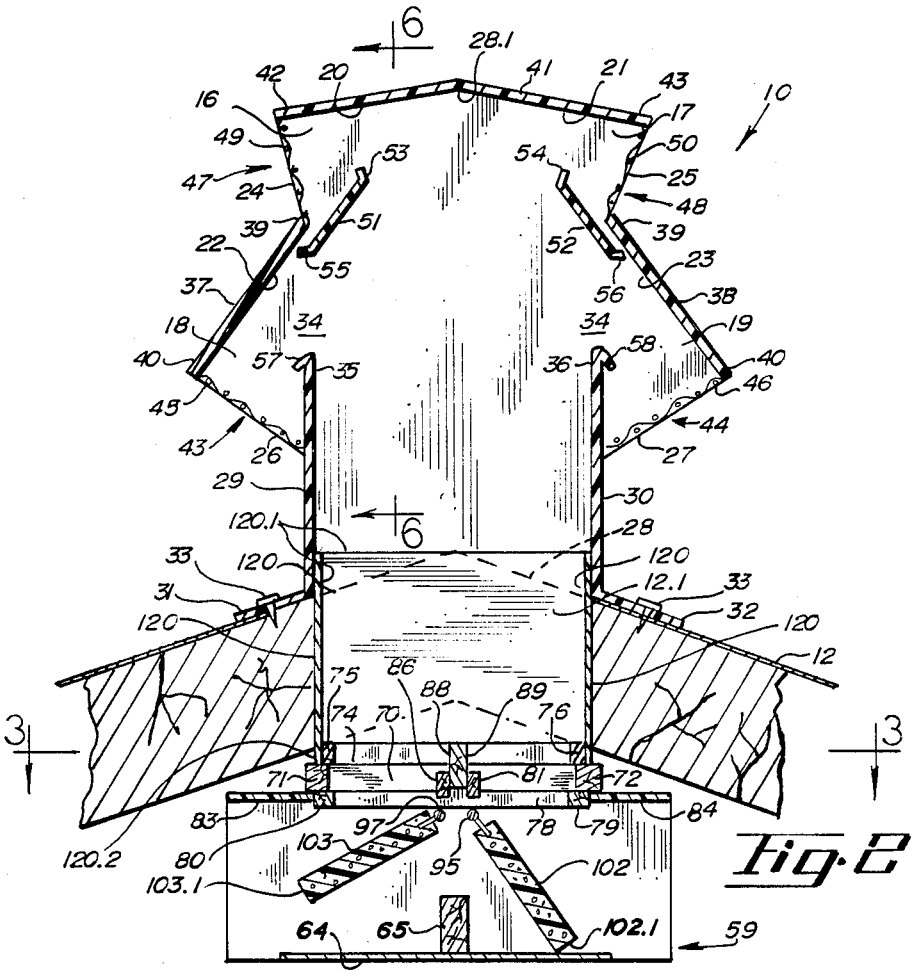
FIG. 2 is an enlarged detailed sectional view at line 2—2 of the air intake apparatus.

As shown in FIGS. 1 and 2, a cupola 10 is mounted on an apex 11 of a roof 12 of a building 13. The cupola 10 is affixed over an inlet 12.1 formed in the apex 11 of the roof 12.

The cupola 10 has a pair of upright end walls 14 and 15. End wall 14 has a pair of upper tapered extensions 16 and 17 and a pair of lower tapered extensions 18 and 19. Extensions 16, 17, 18 and 19 taper away from apex 11 of the roof 12. Upper extensions 16 and 17 have a pair of respective upper inclined edges 20 and 21. Lower extensions 18 and 19 have a pair of respective upper inclined edges 22 and 23. Extensions 16, 17, 18 and 19 also have a set of respective lower inclined edges 24, 25, 26 and 27. End wall 14 has a bottom angled recess 28 for conforming to the apex 11 of the roof 12 and a pointed top end 28.1. End wall 15 is formed similarly to end wall 14.

A pair of upright panels or sidewalls 29 and 30 is affixed to and between the end walls 14 and 15 and to the roof 12. A pair of integrally connected oblique panels 31 and 32 of the end walls 14 and 15 may be affixed to the roof 12 by a plurality of nails 33. The sidewalls 29 and 30 extend up the end walls 14 and 15 to approximately a middle portion 34 of each lower extension 18 and 19. The sidewalls 29 and 30 are elongate with respect to the end walls 14 and 15 and have a pair of respective top edges 35 and 36.

A pair of inclined panels or sidewalls 37 and 38 is mounted on the upper edges 22 and 23 of the lower extensions 18 and 19. The panels 37 and 38 are oblique in relation to the upright sidewalls 29 and 30. Each panel 37 and 38 has an upper end 39 and a lower end 40.

A peaked cover 41 is mounted on the pointed top end 28.1 and the upper edges 20 and 21 of the upper extensions 16 and 17 of the end walls 14 and 15. The peaked cover 41 has a pair of eaves 42 and 43. The cover 41, the end walls 14 and 15, the sidewalls 29 and 30, and the panels 37 and 38 form an exterior housing of the cupola 10 for the collection of fresh air.

A pair of lower, longitudinal, elongate, substantially horizontally disposed openings 43 and 44 is formed by the lower ends 40 of the panels 37 and 38, the top edges 35 and 36 of the sidewalls 29 and 30, and the tapered extensions 18 and 19 of the end walls 14 and 15. The openings 43 and 44 capture fresh air which, for instance, may be driven off of the roof 12 of the building 13. A pair of screens 45 and 46 are affixed to the lower edges 26 and 27 of the extensions 19 and 20, ends 40 of panels 37 and 38, and the sidewalls 29 and 30 to be disposed over the respective openings 43 and 44 to prevent the intake of wind driven articles.

A pair of upper, longitudinal, elongate substantially horizontally disposed openings 47 and 48 is formed by the eaves 42 and 43 of the cover 41, the upper ends 39 of the panels 37 and 38, and the edges 24 and 25 of the upper extensions 16 and 17 of the end walls 14 and 15. The openings 47 and 48 allow for the intake of fresh air. A pair of screens 49 and 50 are affixed to the eaves 42 and 43, the upper ends 39, and the edges 24 and 25 to be disposed over the openings 47 and 48 to prevent the intake of wind driven articles such as leaves and paper.

A pair of oblique, longitudinally elongate baffles 51 and 52 is affixed to and between the end walls 14 and 15. The baffles 51 and 52 are disposed obliquely in relation to the upright sidewalls 29 and 30. Each of the baffles 51 and 52 has a respective upper, integrally connected, longitudinal, elongate lip 53 and 54 extending outwardly and substantially parallel to respective edges 24 and 25 of the upper extensions 16 and 17. Each of the baffles 51 and 52 has a respective, lower, integrally connected, longitudinal, elongate lip 55 and 56 extending outwardly and substantially parallel to respective eaves 42 and 43. The upper lips 53 and 54 are disposed above the upper ends 39 of the panels 37 and 38 and inwardly of the openings 47 and 48 and the sidewalls 29 and 30. The lower lips 55 and 56 are disposed above the lower openings 43 and 44, below the upper ends 39 of the panels 37 and 38, and outwardly of the upright sidewalls 29 and 30. Water driven in the upper openings 47 and 48 is captured by the lips 53 and 54 and the baffles 51 and 52 and flow off the lower lips 55 and 56 and out the lower openings 43 and 44 to the roof 12.

A pair of inclined, longitudinal, elongate lips of flanges 57 and 58 is integrally connected to respective top edges 35 and 36 of the sidewalls 29 and 30. The flanges 57 and 58 extend downwardly and outwardly and substantially parallel to inclined panels 37 and 38. The flanges 57 and 58 direct wind driven snow away from the openings 43 and 44.

Figure 3:
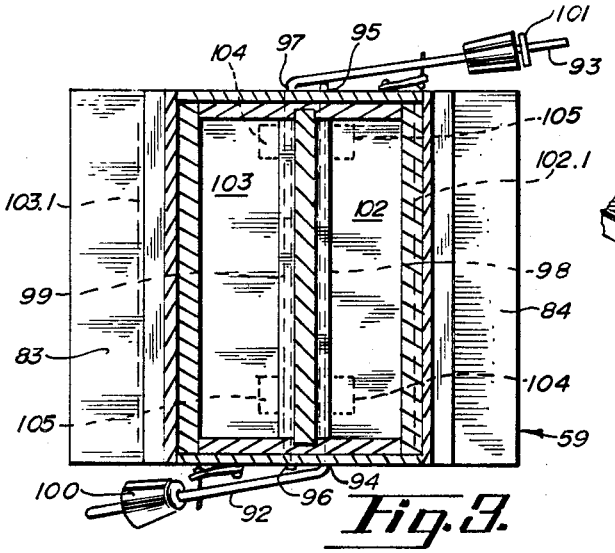
FIG. 3 is a detailed sectional view at line 3—3 of FIG. 2.
Figure 4:
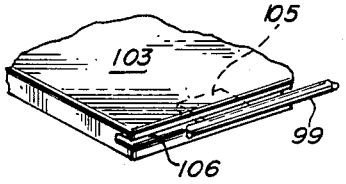
FIG. 4 is a cut away view of a flap shown in FIG. 3.
Figure 6:
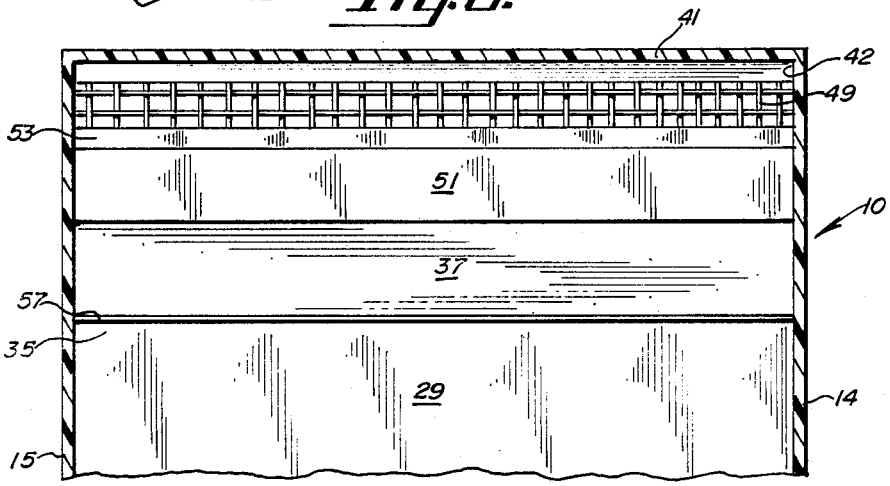
FIG. 6 is a detailed sectional view at line 6—6 of FIG. 2.
Figure 7:
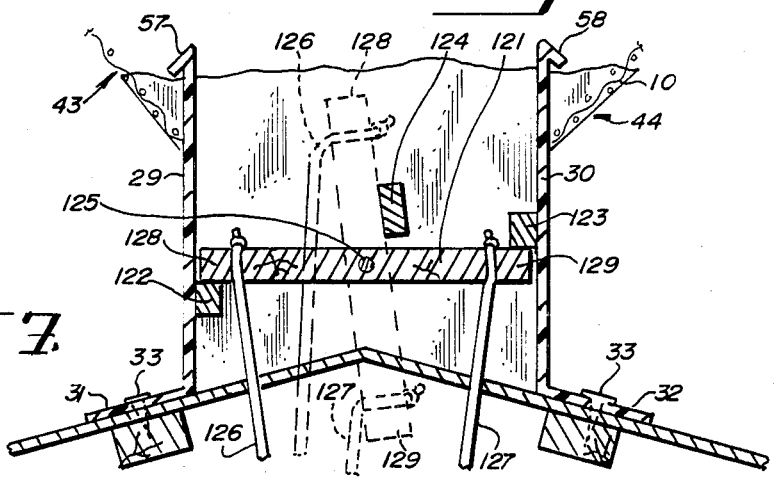
FIG. 7 is a detailed view of an alternate embodiment of the invention.
Figure 5:
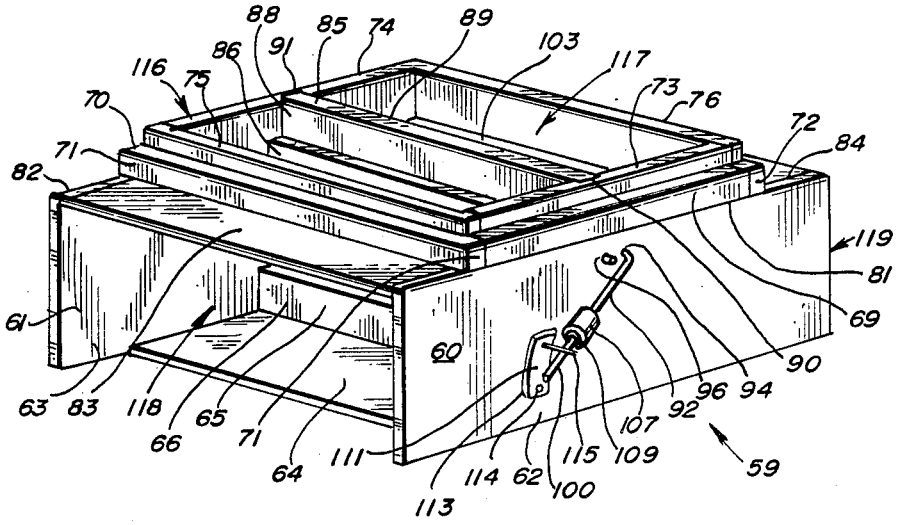
FIG. 5 is a perspective view of the counterweight valve shown in FIGS. 2 and 3.

As shown in FIGS. 2 and 3, a counterweight valve housing 59 has a pair of side panels 60 and 61. The panels 60 and 61 have respective bottom edges 62 and 63.

A bottom panel 64 is affixed centrally to and transversely between the bottom edges 62 and 63 of panels 60 and 61. The bottom panel 64 has a shorter length than the length of side panels 60 and 61.

A central, transversely extending bar 65 is affixed to and between panels 60 and 61 and is mounted centrally on bottom panel 64. The bar 65 has a pair of opposing, vertically extending, planar faces 66 and 67.

A rectangular frame 68 is mounted on and between the side panels 60 and 61. The frame 68 has a pair of opposing, main, longitudinal bars 69 and 70 and a pair of opposing, main, transverse bars 71 and 72. Each bar 69, 70, 71 and 72 has a respective, upper, smaller bar 73, 74, 75 and 76 mounted thereupon so that the inner edges of bars 69, 70, 71 and 72 are flush with the inner edges of bars 73, 74, 75, and 76. Each bar 69, 70, 71, and 72 has a respective, lower, smaller bar 77, 78, 79 and 80 affixed thereto so that the inner edges of bars 69, 70, 71 and 72 are flush with the inner edges of bars 77, 78, 79 and 80. Bars 73, 74, 75, 76, 77, 78, 79 and 80 are smaller in length and cross-section than the main bars 69, 70, 71 and 72.

Main bars 69 and 70 are mounted centrally on a pair of respective upper edges 81 and 82 of the side panels 60 and 61. Longitudinal bars 77 and 78 are affixed to the inside of side panels 60 and 61. The ends of bars 71 and 72 are also mounted on edges 81 and 82, as well as the ends of bars 79 and 80.

A pair of top, transverse, outer panels 83 and 84 are mounted on edges 81 and 82 of the side panels 60 and 61 and is affixed to respective transverse bars 71 and 72. The panels 83 and 84 may also be affixed to smaller bars 79 and 80.

A central, main, transverse bar 85 is affixed to and between longitudinal bars 69, 73 and 77 and longitudinal bars 70, 74, and 78. A pair of smaller, transverse bars 86 and 87 is affixed to opposing faces 88 and 89 of bar 85 and is affixed to and between longitudinal bars 69 and 77 and longitudinal bars 70 and 78. Bar 85 is affixed in a pair of recesses 90 and 91 formed in respective bars 69, 73, and 77, and bars 70, 74, and 78.

A pair of pivoting, angled, stainless steel rods 92 and 93 extends through a set of apertures 94, 95, 96 and 97 formed in the side panels 60 and 61. Rods 92 and 93 have a pair of respective transversely extending rod sections 98 and 99 and a pair of respective, oblique, rod sections 100 and 101 extending outwardly and downwardly from transverse rod sections 98 and 99. Rod section 98 rotates in holes 94 and 95 formed in respective panels 60 and 61. Rod section 99 rotates in holes 96 and 97 formed in respective panels 60 and 61.

A pair of planar rigid styrofoam flaps or valves 102 and 103 is affixed to respective rod sections 98 and 99. The flaps 102, 103 have respective distal ends 102.1, 103.1. Each of the valves 102 and 103 has a pair of plates 104 and 105 affixed in a groove 106 running transversely in the inner edge of each of the valves 102 and 103. One end of each plate 104 and 105 is affixed in the groove 106 and the other end of each plate 104 and 105 is affixed to rod sections 98 and 99.

A pair of lead counterweights 107 and 108 is slideably mounted on respective oblique rod sections 100 and 101. The counterweights 107 and 108 taper inwardly toward transverse rod sections 98 and 99. A pair of rubber stops 109 and 110 is frictionally mounted on respective, oblique rod sections 100 and 101 to control the location of counterweights 107 and 108 which by the force of gravity bear against the rubber stops 108 and 109.

A pair of triggers 111 and 112 is connected to respective side panels 60 and 61 and cooperate with the oblique rod sections 100 and 101. Each of the triggers 111 and 112 has a trigger bar 113 affixed to panels 60 and 61 by a pin 114. A protruding trigger pin 115 is affixed to and extends outwardly from the bar 113 to act as an abutment for oblique rod sections 100 and 101.

A first inlet passage 116 is formed between bars 71 and 85. A second inlet passage 117 is formed between bars 72 and 85. A first outlet passage 118 is formed between valve 102 and top panel 83. A second outlet passage 119 is formed between valve 103 and top panel 84.

A duct means 120 is affixed to the roof 12 at a proximal end 120.1 in the inlet 14 and extends downwardly therefrom to be affixed to the frame 68 at a distal end 120.2. Typically, a single cupola 10 will cooperate with a pair of counterweight valve housings 59 wherein each said valve housing 59 has a pair of valve flaps 102 and 103.

In operation, the counterweights 107 and 108 are set to a prescribed location on rod sections 100 and 101 by manually moving the rubber stops 109 and 110. The counterweights 107 and 108 act as counter balances for the flaps 102 and 103. The location and mass of the counterweights 107 and 108 control the amount of movement of the flaps 102 and 103 and thereby the size of the outlet passages 118 and 119. For a given amount of negative static pressure in the building 13, the further the counterweights 107 and 108 are set down and away from their respective flaps 102 and 103, the smaller the size of the outlet passages 118 and 119. Conversely, the closer the counterweights 107 and 108 are set to their respective flaps 102 and 103, the greater the size of the outlet passages 118 and 119 for a given amount of negative static pressure in the building 13.

When the static pressure of the interior of the building 13 is equal to the outside of the building 13, the flaps 102 and 103 rest in a closed position so that their upper faces abut the lower faces of respective top panels 83 and 84. The oblique rod sections 100 and 101 rest in a position downwardly and away from trigger pin 115.

When a negative pressure is created in the interior of the building 13 such as when air is exhausted therefrom, air flowing in openings 43 and 44 and 47 and 48 flows through inlet 14 and duct 120 to the inlet passages 116 and 117 of the counterweight valve housings 59. The air movement, which is determined by the amount of negative static pressure, then bears against the rigid flaps 102 and 103. The flaps 102 and 103 subsequently open to form outlet passages 118 and 119 and allow air to pass therethrough to the interior of the building 13.

Air continues to flow through the passages 116, 117, 118 and 119 as long as a negative static pressure exists in the building 13. If the negative static pressure is increased such as when a greater amount of air is exhausted from the building 13, the greater movement of air opens the flaps 102 and 103 to increase the size of the outlet passages 118 and 119. The oblique rod sections 100 and 101 and the counterweights 107 and 108 swing upwardly. When the negative pressure is sufficiently great, the rod sections 100 abut the trigger pin 115 so as to preclude further opening of the flaps 102 and 103.

If the negative static pressure is decreased, the force of gravity draws the counterweights 107 and 108 downwardly, which in turn moves the flaps 102 and 103 so as to decrease the size of the outlet passages 118 and 119. When a negative static pressure ceases to exist, the counterweights 107 and 108 are drawn downwardly by gravity to close the passages 118 and 119.

It should be noted that either great or minute quantities of air may be introduced into the building 13. If power vents are drawing air rapidly from the building 13, then the flaps 102 and 103 allow a corresponding amount of air intake. If the power vents are drawing at a slow rate, such as during the winter months, the flaps 102 and 103 may open as little as five one-hundredths of an inch. Thus, minute, uniform quantities of air may be introduced from a number of counterweight valves 59. It may be more beneficial to introduce a cupful of fresh air at a large number of intake points than to inject a bucketful of air at merely a few intake points.

It should also be noted that the flaps 102 and 103 direct air horizontally across the interior of building 13 to which the cupola 10 is affixed. The air travels horizontally until it expends its original physical energy. Hence, when a large temperature differential exists between the interior of the building 13 such as during the winter months, fresh air is distributed over a maximum area with little decrease in the desired temperature of the building's interior.

It should be further noted that the counterweight valves 59 may be affixed to a wall, as well as the ceiling of building 13. If installed and disposed vertically on a wall, the outside temperature may dictate the impingement angle of the air introduced into the building. During the winter months, one of the flaps 102 and 103 would be disposed above the other. The lower flap would be closed and the upper flap is operational to direct cold air upwards and away from the occupants of the building. During the summer months, the lower flap is operational to convey air in the proximity of the occupants.

It should further be noted that the cupola 10 may be fabricated from fiberglass. Since the cupola 10 is exposed to the elements, a cupola formed of fiberglass is more durable and less susceptible to rust than cupolas formed from other materials such as metals.

In an alternate embodiment of the present invention, an elongate substantially planar damper 121 is pivotally affixed and extends to the end walls 14 and 15. The damper 121 also extends to the sidewalls 29 and 30 where it abuts a pair of elongate, horizontal, closed damper stops 122 and 123 affixed to respective sidewalls 29 and 30. In its closed position, the bottom face of the damper 121 abuts the upper end of the damper stop 122 and the upper face of damper 121 abuts the lower end of damper stop 123. A single, vertical, opened damper stop 124 is affixed to end wall 14 off center from a central pivot 125 of the modulating damper and closer to stop 123 than stop 122. In an opened position, damper 121 abuts stop 124. A pair of ropes 126 and 127 is connected to a pair of opposite ends 128 and 129 of the damper 121 to control the movement thereof. In operation, when the damper 121 is to be opened, rope 127 is pulled. When the damper 121 is to be closed, rope 126 is pulled. Moreover, static pressure in the building 13 may control opening and closing of the damper 121. If static pressure opens damper 121, the damper 121 may pivot slightly.

I claim:

1. A cupola mounted on an apex of a roof of a building and over an inlet formed in the roof, comprising a housing having a pair of sidewalls, a pair of upright end walls, and a cover, a pair of upper, vertically disposed elongate openings and a pair of lower horizontally disposed elongate openings formed in said sidewalls of said housing for the intake of air, and a set of elongate rain baffles having bottom lips and connected to said end walls of said housing, said baffles disposed inwardly of said upper openings and obliquely to said sidewalls, said bottom lips of said baffles located above said lower openings so that said baffles collect wind driven rain entering said upper openings and deflect the rain out of said apparatus through said lower openings so that said cupola collects air substantially free of rain for the interior of the building.

2. The cupola of claim 1, wherein said baffles include integrally mounted elongate upper lips, said upper lips disposed inwardly of and above said upper openings to catch wind driven rain entering said upper openings.

3. The cupola of claim 1, wherein said sidewalls include a pair of upper inclined panels and a pair of lower upright panels, said upper openings being formed between said cover and said upper inclined panels, said lower openings being formed between said upper inclined panels and said lower upright panels.

4. A cupola mounted on an apex of a roof of a building and over an inlet formed in the roof, comprising a housing having a pair of sidewalls, a pair of upright end walls, and a cover, a pair of upper, vertically disposed elongate openings and a pair of lower horizontally disposed elongate openings formed in said sidewalls of said housing for the intake of air, and a set of outwardly and downwardly protruding flanges integrally mounted on said sidewalls of said housing and deflecting wind driven particulates away from said lower openings so that said cupola collects air substantially free of particulates for the interior of the building.

5. The cupola of claim 4, wherein said sidewalls include a pair of upper inclined panels and a pair of lower upright panels having upper edges, said upper openings being formed between said cover and said upper inclined panels, said lower openings being formed between said upper inclined panels and said lower upright panels, said flanges being mounted on said upper edges of said upright panels.

6. A cupola mounted on an apex of a roof of a building and over an inlet formed in the roof, comprising a housing having a pair of sidewalls, a pair of upright end walls, and a cover, a pair of upper, vertically disposed elongate openings and a pair of lower horizontally disposed elongate openings formed in said sidewalls of said housing for the intake of air, a set of elongate rain baffles having bottom lips and connected to said end walls of said housing, said baffles disposed inwardly of said upper openings and obliquely to said sidewalls, said bottom lips of said baffles located above said lower openings so that said baffles collect wind driven rain entering said upper openings and deflect the rain out of said apparatus through said lower openings so that said cupola collects air substantially free of rain for the interior of the building, and a set of outwardly and downwardly protruding flanges integrally mounted on said sidewalls of said housing and deflecting wind driven particulates away from said lower openings so that said cupola collects air substantially free of particulates for the interior of the building.

7. The cupola of claim 6, wherein said baffles include integrally mounted elongate upper lips, said upper lips disposed inwardly of and above said upper openings to catch wind driven rain entering said upper openings.

8. The cupola of claim 6, wherein said sidewalls include a pair of upper inclined panels and a pair of lower upright panels having upper edges, said upper openings being formed between said cover and said upper inclined panels, said lower openings being formed between said upper inclined panels and said lower upright panels, said flanges being mounted on said upper edges of said upright panels.

9. A cupola mounted on an apex of a roof of a building and over an inlet formed in the roof, comprising a housing having a pair of sidewalls, a pair of upright end walls, and a cover, a pair of upper, vertically disposed elongate openings and a pair of lower horizontally disposed elongate openings formed in said sidewalls of said housing for the intake of air, a set of elongate rain baffles having bottom lips and connected to said end walls of said housing, said baffles disposed inwardly of said upper openings and obliquely to said sidewalls, said bottom lips of said baffles located above said lower openings to that said baffles collect wind driven rain entering said upper openings and deflect the rain out of said apparatus through said lower openings so that said cupola collects air substantially free of rain from the interior of the building, a set of outwardly and downwardly protruding flanges integrally mounted on said sidewalls of said housing and deflecting wind driven particulates away from said lower openings so that said cupola collects air substantially free of particulates for the interior of the building, and valve means for metering the amount of air introduced to the interior of the building from said housing, said valve means connected to said housing and having a passage in communication with said elongate openings.

10. The cupola of claim 9, wherein said valve means comprises a casing forming inlet and outlet apertures, said inlet aperture cooperating with a duct extending from said housing so that air collected by said housing is introduced into said casing through said inlet aperture, said outlet aperture allowing air to flow from said casing to the interior of the building, a flap pivotally connected in said casing for covering and controlling air flow through said outlet aperture, a rod having proximal and distal ends, said proximal end affixed to said flap and said distal end extending from said casing, and a counterweight affixed to said distal end of said rod, said counterweight controlling said flap and metering the amount of air flowing through said outlet aperture, said counterweight closing said flap when a sufficient amount of air has been introduced to the interior of the building.

11. The cupola of claim 9, wherein said valve means comprises an elongate, substantially planar modulating damper pivotally connected to said end walls, said damper extending to said end and sidewalls, said damper having a pair of side edges and a pair of ends, a pair of side stops affixed to said sidewalls and an end stop affixed to one of said end walls, said side edges being abuttable against said side stops, one of said side edges abuttable against a top end of one of said side stops, the other of said side edges abuttable against a bottom end of the other of said side stops when said damper closes said passage, one of said ends being abuttable against said end stop when said damper opens said passage, and a pair of ropes connected to said side edges, said ropes pivotally opening and closing said damper so as to control the amount of air flowing from said housing to the interior of the building.

12. A cupola mounted on an apex of a roof of a building and over an inlet formed in the roof, comprising a pair of upright end walls, each of said end walls having a recessed bottom edge for conforming to the apex, a pointed top end, a pair of upper tapered extensions tapering outwardly, and a pair of lower tapered extensions, each of said upper and lower extensions having upper and lower edges, a pair of upright sidewalls affixed to and between said end walls, said sidewalls being elongate with respect to said end walls and having a pair of top edges, a pair of inclined panels mounted on said upper edges of said lower tapered extensions, said panels being oblique with respect to said upright sidewalls, a cover mounted on said pointed top end and said upper edges of said upper extensions, said cover, end walls, sidewalls, and panels forming a housing for the collection of fresh air, a pair of longitudinal lower elongate horizontally disposed openings for the intake of fresh air, said horizontally disposed openings extending to each of said end walls and being formed between said panels and said top edges of said upright sidewalls, a pair of longitudinal upper elongate vertically disposed openings for the intake of fresh air, said vertically disposed openings extending to each of said end walls and being formed between said cover and said panels, and a pair of oblique longitudinal elongate baffles connected to said end walls, said baffles being oblique in relation to said upright sidewalls, each of said baffles having a pair of upper and lower integrally mounted longitudinal elongate lips, said upper lips disposed inwardly of and above said panels to catch wind driven rain, said lower lips disposed above said lower openings to allow water flowing from said upper lips to flow off said lower lips to be directed out of said lower openings.

13. A cupola mounted on an apex of a roof of a building and over an inlet formed in the roof, comprising a pair of upright end walls, each of said end walls having a recessed bottom edge for conforming to the apex, a pointed top end, a pair of upper tapered extensions tapering outwardly, and a pair of lower tapered extensions, each of said upper and lower extensions having upper and lower edges, a pair of upright sidewalls affixed to and between said end walls, said sidewalls being elongate with respect to said end walls and having a pair of top edges, a pair of inclined panels mounted on said upper edges of said lower tapered extensions, said panels being oblique with respect to said upright sidewalls, a cover mounted on said pointed top end and said upper edges of said upper extensions, said cover, end walls, sidewalls, and panels forming a housing for the collection of fresh air, a pair of longitudinal lower elongate horizontally disposed openings for the intake of fresh air, said horizontally disposed openings extending to each of said end walls and being formed between said panels and said top edges of said upright sidewalls, a pair of longitudinal upper elongate vertically disposed openings for the intake of fresh air, said vertically disposed openings extending to each of said end walls and being formed between said cover and said panels, and a pair of longitudinal elongate flanges integrally mounted on said top edges of said upright sidewalls and protruding downwardly and outwardly therefrom to direct wind driven snow and air away from said horizontally disposed opening.

14. A cupola mounted on an apex of a roof of a building and over an inlet formed in the roof, comprising a pair of upright end walls, each of said end walls having a recessed bottom edge for conforming to the apex, a pointed top end, a pair of upper tapered extensions tapering outwardly, and a pair of lower tapered extensions, each of said upper and lower extensions having upper and lower edges, a pair of upright sidewalls affixed to and between said end walls, said sidewalls being elongate with respect to said end walls and having a pair of top edges, a pair of inclined panels mounted on said upper edges of said lower tapered extensions, said panels being oblique with respect to said upright sidewalls, a cover mounted on said pointed top end and said upper edges of said upper extensions, said cover, end walls, sidewalls, and panels forming a housing for the collection of fresh air, a pair of longitudinal lower elongate horizontally disposed openings for the intake of fresh air, said horizontally disposed openings extending to each of said end walls and being formed between said panels and said top edges of said upright sidewalls, a pair of longitudinal upper elongate vertically disposed openings for the intake of fresh air, said vertically disposed openings extending to each of said end walls and being formed between said cover and said panels, a pair of oblique longitudinal elongate baffles connected to said end walls, said baffles being oblique in relation to said upright sidewalls, each of said baffles having a pair of upper and lower integrally mounted longitudinal elongate lips, said upper lips disposed inwardly of and above said panels to catch wind driven rain, said lower lips disposed above said lower openings to allow water flowing from said upper lips to flow off said lower lips to be directed out of said lower openings, and a pair of longitudinal elongate flanges integrally mounted on said top edges of said upright sidewalls and protruding downwardly and outwardly therefrom to direct wind driven snow and air away from said horizontally disposed opening.

15. A cupola mounted on an apex of a roof of a building and over an inlet formed in the roof, comprising a pair of upright end walls, each of said end walls having a recessed bottom edge for conforming to the apex, a pointed top end, a pair of upper tapered extensions tapering outwardly, and a pair of lower tapered extensions, each of said upper and lower extensions having upper and lower edges, a pair of upright sidewalls affixed to and between said end walls, said sidewalls being elongate with respect to said end walls and having a pair of top edges, a pair of inclined panels mounted on said upper edges of said lower tapered extensions, said panels being oblique with respect to said upright sidewalls, a cover mounted on said pointed top end and said upper edges of said upper extensions, said cover, end walls, sidewalls, and panels forming a housing for the collection of fresh air, a pair of longitudinal lower elongate horizontally disposed openings for the intake of fresh air, said horizontally disposed openings extending to each of said end walls and being formed between said panels and said top edges of said upright sidewalls, a pair of longitudinal upper elongate vertically disposed openings for the intake of fresh air, said vertically disposed openings extending to each of said end walls and being formed between said cover and said panels, a pair of oblique longitudinal elongate baffles connected to said end walls, said baffles being oblique in relation to said upright sidewalls, each of said baffles having a pair of upper and lower integrally mounted longitudinal elongate lips, said upper flanges disposed inwardly of and above said panels to catch wind driven rain, said lower lips disposed above said lower openings to allow water flowing from said upper lips to flow off said lower lips to be directed out of said lower openings, a pair of longitudinal elongate flanges integrally mounted on said top edges of said upright sidewalls and protruding downwardly and outwardly therefrom to direct wind driven snow and air away from said horizontally disposed opening, a duct having proximal and distal ends for conveying air from said housing to the interior of the building, said proximal end of said duct affixed to said housing, said duct extending therefrom to be affixed at said distal end to the interior of the building, a counterweight valve affixed to said distal end of said duct means at the interior of the building and having a casing, a pair of rigid flaps pivotally mounted in said casing, and a pair of rods affixed to said flaps and having counterweights, said rods extending from said casing, said flaps covering a pair of outlet passages formed in said casing, said passages extending from said duct to the interior of the building for conveying air from said duct to the interior of the building, said flaps opening to allow the passage of air when a pressure differential is created between the interior and exterior of the structure, said counterweight controlling the distance said flaps open and the amount of air allowed to pass therethrough, said counterweights being adjustable for responding to greater or lesser pressure differentials.

16. A cupola mounted on an apex of a roof of a building and over an inlet formed in the roof, comprising a pair of upright end walls, each of said end walls having a recessed bottom edge for conforming to the apex, a pointed top end, a pair of upper tapered extensions tapering outwardly, and a pair of lower tapered extensions, each of said upper and lower extensions having upper and lower edges, a pair of upright sidewalls affixed to and between said end walls, said sidewalls being elongate with respect to said end walls and having a pair of top edges, a pair of inclined panels mounted on said upper edges of said lower tapered extensions, said panels being oblique with respect to said upright sidewalls, a cover mounted on said pointed top end and said upper edges of said upper extensions, said cover, end walls, sidewalls, and panels forming a housing for the collection of fresh air, a pair of longitudinal lower elongate horizontally disposed openings for the intake of fresh air, said horizontally disposed openings extending to each of said end walls and being formed between said panels and said top edges of said upright sidewalls, a pair of longitudinal upper elongate vertically disposed openings for the intake of fresh air, said vertically disposed openings extending to each of said end walls and being formed between said cover and said panels, a pair of oblique longitudinal elongate baffles connected to said end walls, said baffles being oblique in relation to said upright sidewalls, each of said baffles having a pair of upper and lower integrally mounted longitudinal elongate lips, said upper flanges disposed inwardly of and above said panels to catch wind driven rain, said lower lips disposed above said lower openings to allow water flowing from said upper lips to flow off said lower lips to be directed out of said lower openings, a pair of longitudinal elongate flanges integrally mounted on said top edges of said upright sidewalls and protruding downwardly and outwardly therefrom to direct wind driven snow and air away from said horizontally disposed opening, an elongate, substantially planar modulating damper pivotally connected to said end walls, said damper extending to said end and sidewalls, said damper having a pair of side edges and a pair of ends, a pair of side stops affixed to said sidewalls and an end stop affixed to said end walls, said side edges being abuttable against said side stops, one of said side edges abuttable against a top end of one of said side stops, the other of said side edges abuttable against a bottom end of the other of said side stops when said damper closes said passage, one of said ends being abuttable against said end stop when said damper opens said passage, and a pair of ropes connected to said side edges, said ropes pivotally opening and closing said damper so as to control the amount of air flowing from said housing to the interior of the building.

* * * * *